US005881647A

United States Patent [19]

Siler et al.

[11] Patent Number: 5,881,647

[45] Date of Patent: Mar. 16, 1999

[54] PRINTING PRESS WITH ELECTROSTATIC COOLING

[75] Inventors: Steven J. Siler, Cary, Ill.; David M. Klein, Fontana, Wis.

[73] Assignee: Hurletron, Incorporated, Danville, Ill.

[21] Appl. No.: 920,465

[22] Filed: Aug. 29, 1997

[51] Int. Cl.[6] ..... B41F 5/06

[52] U.S. Cl. ..... 101/488; 34/254; 101/219; 101/424.1

[58] Field of Search ..... 101/488, 219, 101/424.1; 34/254, 393, 638

[56] References Cited

U.S. PATENT DOCUMENTS

| | | | |
|---|---|---|---|
| 2,221,338 | 11/1940 | Wintermute | 91/8 |
| 2,333,220 | 11/1943 | Weiss | 101/152 |
| 2,408,498 | 10/1946 | Welk | 101/416 |
| 2,421,787 | 6/1947 | Helmuth | 117/93 |
| 2,464,119 | 3/1949 | Dawson | 34/155 |
| 2,794,751 | 6/1957 | Juvinall | 117/93 |
| 2,877,137 | 3/1959 | Juvinall | 117/93 |
| 2,894,175 | 7/1959 | Lamm | 317/3 |
| 3,076,124 | 1/1963 | Viscardi | 317/2 |
| 3,318,018 | 5/1967 | Steele et al. | 34/62 |
| 3,323,934 | 6/1967 | Point | 117/17 |
| 3,467,541 | 9/1969 | Aronsson et al. | 117/93.4 |
| 3,578,486 | 5/1971 | Fenton | 117/93.41 |
| 3,930,614 | 1/1976 | Krenkel | 239/15 |
| 4,219,864 | 8/1980 | Grunenfelder et al. | 361/228 |
| 4,567,673 | 2/1986 | Böhnensieker | 101/424.1 |
| 4,689,895 | 9/1987 | Taylor et al. | 321/20 |
| 4,702,015 | 10/1987 | Taylor et al. | 34/20 |
| 4,939,992 | 7/1990 | Bird | 101/183 |
| 5,056,431 | 10/1991 | Sainio | 101/219 |
| 5,184,555 | 2/1993 | Quadracci et al. | 101/424.1 |
| 5,275,103 | 1/1994 | Hahne | 101/488 |
| 5,502,788 | 3/1996 | Platsch | 392/424 |
| 5,642,671 | 7/1997 | Winheim | 101/424.1 |
| 5,669,158 | 9/1997 | Murray et al. | 34/393 |

FOREIGN PATENT DOCUMENTS

| | | | |
|---|---|---|---|
| 32 07 463 A1 | 9/1983 | Germany | 101/424.1 |
| 31 15958 | 12/1983 | Germany . | |
| 36 43 380 | 6/1991 | Germany . | |
| 2 102 344 | 2/1983 | United Kingdom | 101/488 |

OTHER PUBLICATIONS

Product brochure entitled "The New Electrostatic Remoistening Unit Eltex LG50", 4 pages (prior art).

Eltex brochure Figs. 16–18, 3 pages (prior art).

*Primary Examiner*—Edgar Burr

*Assistant Examiner*—Leslie Grohusky

*Attorney, Agent, or Firm*—Marshall, O'Toole, Gerstein, Murray & Borun

[57] ABSTRACT

A web-offset printing press is provided with a first rotatable printing cylinder adapted to print a first image on a web by applying a heat-settable ink to the web, a second rotatable printing cylinder adapted to print a second image on the web, the second image being printed on the web subsequent to the first image being printed on the web by applying a heat-settable ink to the web, a drying station for drying the heat-settable ink applied to the web by the first and second rotatable printing cylinders by heating the web to an initial temperature, and a cooling station disposed adjacent the drying station, the cooling station receiving the web after the web has been heated by the drying station, the cooling station causing the initial temperature of the web to be reduced by at least about 20° F. The cooling station generates a directed electrostatic field through which the web passes and sprays liquid droplets onto the web to cool the web by evaporation of the liquid droplets from the web, the electrostatic field causing the liquid droplets to pass through a confined path between spray nozzles and the web.

17 Claims, 3 Drawing Sheets

PRINTING PRESS WITH ELECTROSTATIC COOLING

BACKGROUND OF THE INVENTION

The invention is directed to a web-offset printing press that utilizes heat-settable ink and which has a dryer for curing the ink after it has been applied to a paper web and a cooler for cooling the paper web after it has passed through the dryer.

Conventional web-offset printing presses utilize heat-settable ink that is set or cured by heat after the ink is printed onto a paper web. The curing of the ink is typically done by passing the web through a dryer, which causes the temperature of the web to be raised to a relatively high temperature, such as in the range of 230° to 320° Fahrenheit (°F). After it passes from the dryer, the hot web must be cooled to allow effective processing of the web in subsequent operations.

FIG. 1 schematically illustrates a prior art web-offset printing press 10 of the type described generally above. Referring to FIG. 1, the prior art printing press 10 incorporates a plurality of rotatable printing cylinders 12, 14, each of which applies an image to a paper web 16 using a heat-settable ink. The paper web 16, which is guided by a number of rollers 18, passes through the printing press 10 from left to right, as indicated by the arrow shown in FIG. 1.

After the ink is applied by the printing cylinders 12, 14, the web 16 is passed through a dryer 20, which sets the ink by raising the temperature of the web 16 to a relatively high temperature. After passing through the dryer 20, the web 16 is passed over a plurality of chill rolls 22 to cool the web 16. Heat from the web 16 is absorbed by relatively cool water which is piped through the chill rolls 22. After passing through all of the chill rolls 22, the web 16 is at or close to (within 10° F.) room temperature.

After being heated by the dryer 20 and cooled by the chill rolls 22, the paper web 16 has very little moisture content. Consequently, after being cooled by the chill rolls 22, the web 16 is fed to an electrostatic remoistener 24 which adds moisture back to the web 16. The remoistener 24 is provided with a plurality of spray nozzles (not shown) for spraying water droplets onto the paper web 16 and a plurality of field directors (not shown) on each side of the web 16 for generating a directed electrostatic field. The field directors on one side of the web 16 are maintained at a high voltage relative to the field directors on the other side of the web 16, and water is sprayed through the electrostatic field so that the water droplets travel within a confined path between the spray nozzles and the paper web 16.

SUMMARY OF THE INVENTION

The invention is directed to a web-offset printing press having a first rotatable printing cylinder adapted to print a first image on a web by applying a heat-settable ink to the web, a second rotatable printing cylinder adapted to print a second image on the web subsequent to the first image being printed on the web by applying a heat-settable ink to the web, a drying station for drying the heat-settable ink applied to the web by the printing cylinders by heating the web to an initial temperature, and a cooling station disposed adjacent the drying station, the cooling station receiving the web after the web has been heated by the drying station, the cooling station causing the initial temperature of the web to be reduced by at least about 20° F. The cooling station includes means for generating a directed electrostatic field through which the web passes and spray means for spraying liquid droplets onto the web to cool it by evaporation of the liquid droplets from the web, the electrostatic field causing the liquid droplets to pass through a confined path between the spray means and the web.

The spray means may include a plurality of atomizing spray nozzles each of which is connected to a source of liquid and to a source of air, and the cooling station may include a cabinet for substantially enclosing the means for generating the directed electrostatic field and the spray means.

The means for generating the directed electrostatic field may include a plurality of first field directors disposed on a first side of the web, each of the first field directors having a plurality of pointed electrodes, a plurality of the second field directors disposed on a second side of the web opposite the first side, each of the second field directors having a plurality of pointed electrodes, and means for supplying a relatively high voltage to the pointed electrodes of one of the first or second field directors.

The means for generating the directed electrostatic field and the spray means may cause the initial temperature of the web to be reduced by at least about 50° F., or alternatively, by at least about 100° F. The invention may also include a second cooling station disposed adjacent the first cooling station for further reducing the temperature of the web by at least about 20° F.

The invention is also directed to a method of operating a printing press that includes the steps of applying a heat-settable ink to a web with a rotatable printing cylinder, passing the web through a drying station after the heat-settable ink has been applied to the web, generating a directed electrostatic field, causing the web to pass through the electrostatic field after the web passes out of the drying station, and spraying liquid droplets through the electrostatic field and onto the web after the web passes out of the drying station to cause the initial temperature of the web, when it passes out of the drying station, to be reduced by at least about 20° F.

These and other features of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
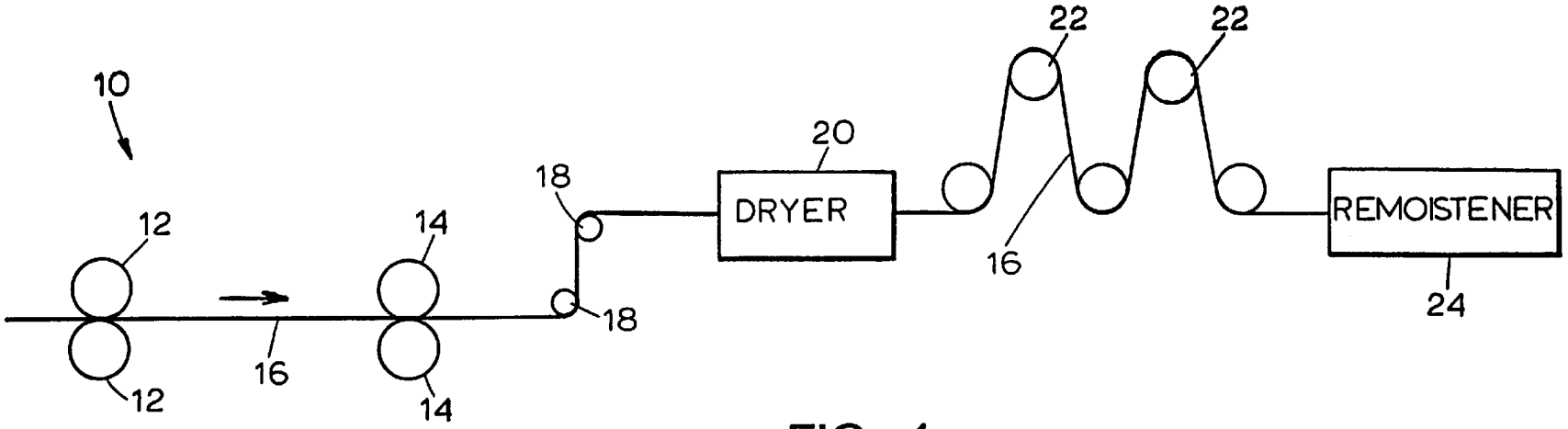
FIG. 1 PRIOR ART
FIG. 1 is a block diagram of a prior art printing press.
Figure 2:
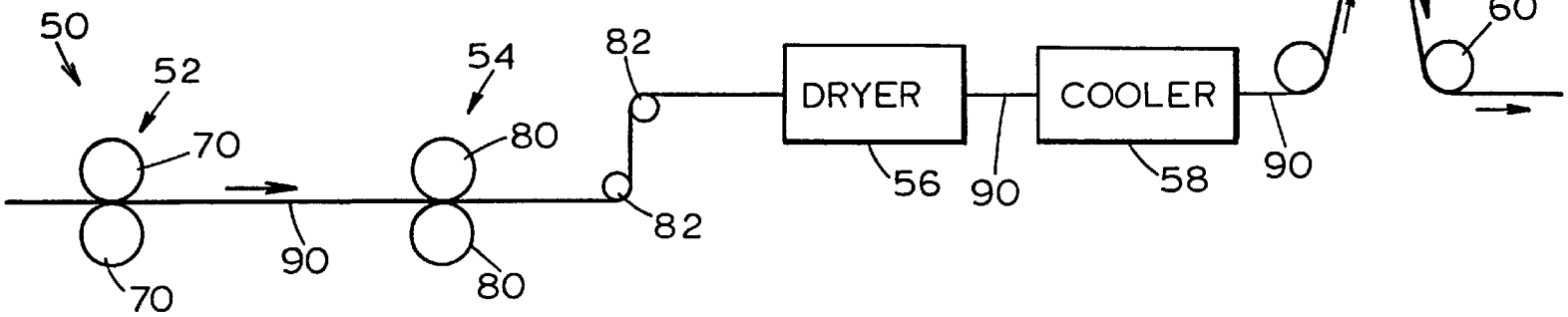
FIG. 2 is a block diagram of a preferred embodiment of a printing press in accordance with the invention.

FIG. 2 illustrates a preferred embodiment of a web-offset printing press 50 in accordance with the invention. Referring to FIG. 2, the printing press 50 has a first printing station 52, a second printing station 54, a dryer 56, a first cooling station in the form of an electrostatic cooler 58 positioned directly adjacent the dryer 56, and an optional second cooling station in the form of a plurality of chill rolls 60.

The first printing station 52 includes a pair of rotatable printing cylinders 70, the second printing station 54 includes a pair of rotatable printing cylinders 80, and the printing press 50 includes a plurality of guide rollers 82. It should be understood that while only two printing stations are shown, a multi-color printing press typically has at least four printing stations, each of which prints images on the web 90 in a different color.

A portion of a web 90, such as paper, is shown to pass successively from the first printing station 52, to the second printing station 54, to the dryer 56, to the electrostatic cooler 58 and to the chill rolls 60, in the direction indicated by the arrows. During printing, as the web 90 passes through the first printing station 52, images in a heat-settable ink of a first color are applied to both sides of the web 90 by the printing cylinders 70. As the web 90 passes through the second printing station 54, images in a heat-settable ink of a second color are printed on both sides of the web 90 by the printing cylinders 80 in alignment or registration with the images previously printed by the cylinders 70.

After being printed by the printing stations 52, 54, the web 90 passes through the dryer 56, which sets the ink by raising the temperature of the web 90 to a relatively high temperature, such as 300° F. From the dryer 56, the web 90 passes directly into the electrostatic cooler 58, which cools the web 90 to a temperature much lower than 300°, such as a temperature between about 80° and 120° F., for example. If its temperature is substantially greater than room temperature when the web 90 exits the electrostatic cooler 58, the web 90 may be passed over one or more optional chill rolls 60 to further lower the temperature of the web 90 to a temperature at or near room temperature.

Figure 3:
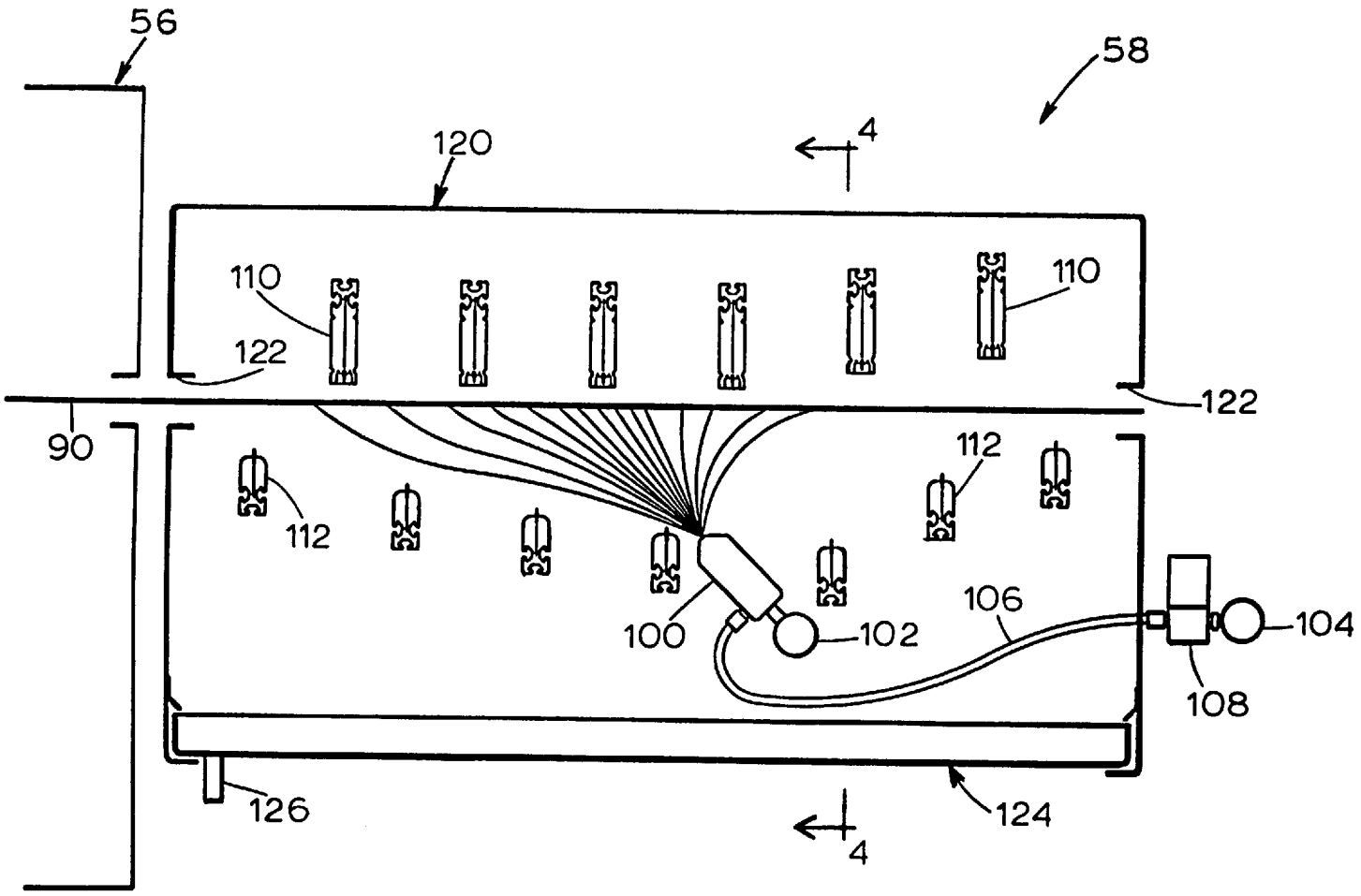
FIG. 3 is a side view of the electrostatic cooler shown schematically in FIG. 2.
Figure 4:
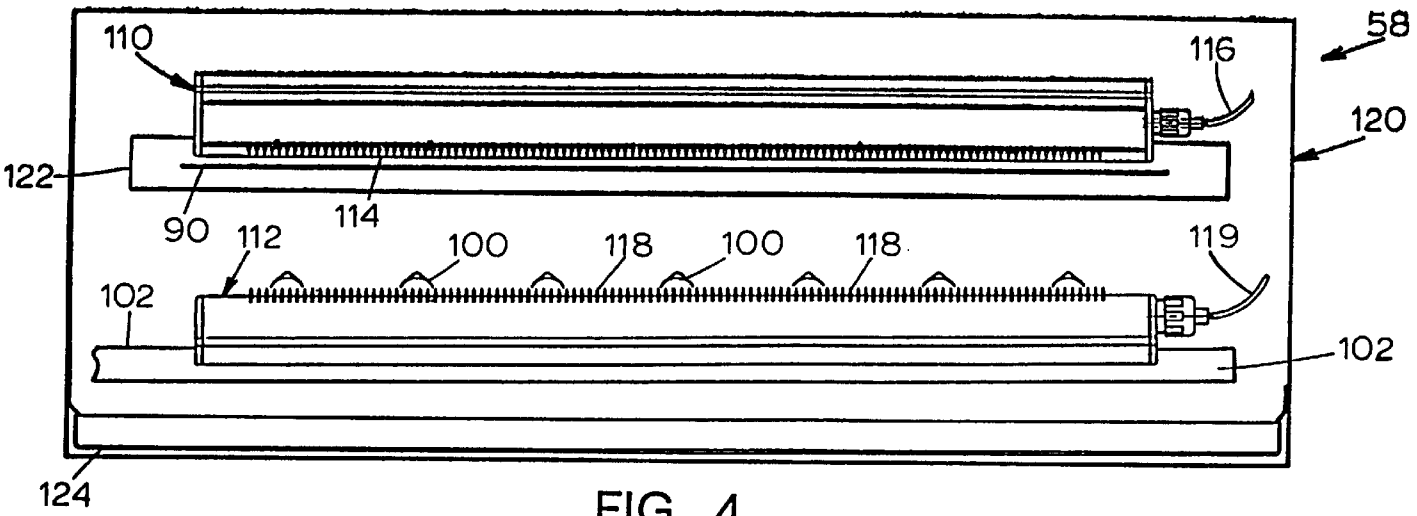
FIG. 4 is a cross-sectional view of the electrostatic cooler taken along lines 4—4 of FIG. 3.

FIG. 3 is a side view of the internal structure of the electrostatic cooler 58 and a portion of the dryer 56 shown schematically in FIG. 2, and FIG. 4 is a side view of the internal structure of the electrostatic cooler 58 taken along lines 4—4 in FIG. 3. Referring to FIGS. 3 and 4, the electrostatic cooler 58 has a plurality of atomizing spray nozzles 100 that are aligned in a direction generally transverse to the longitudinal axis of the web 90. The nozzles 100, which are used to spray very fine water droplets onto the underside of the web 90, are fluidly connected to a source of water in the form of a water header pipe 102 and a source of air in the form of an air header pipe 104 via a hose 106 and an electro-pneumatic valve 108.

The electrostatic cooler 58 has a plurality of upper field directors 110 positioned above the web 90 and a plurality of lower field directors 112 positioned below the web 90. As shown in FIG. 4, the field directors 110, 112 are generally in the form of elongate bars which extend transversely to the longitudinal axis of the web 90.

Each of the upper field directors 110 is provided with row of sharply pointed metal electrodes 114 (see also FIG. 5) which are connected to a relatively high voltage, such as ±20,000 volts or more, via a cable 116 electrically connected to the pointed electrodes 114, and each of the lower field directors 112 is provided with a similar row of sharply pointed electrodes 118, which are connected to electrical ground via a cable 119.

Because of the relatively high voltage across the pointed electrodes 114, 118 of the upper and lower field directors 110, 112, an electrostatic field is created within the electrostatic cooler 58. Both the web 90 and the water droplets sprayed by the spray nozzles 100 pass through the electrostatic field, which is well-defined since multiple field directors 110, 112, each having evenly spaced pointed electrodes 114, 118, are used above and below the web 90.

That electrostatic field effectively confines the path of the water droplets to a well-defined area between the spray nozzles 100 and the web 90 and prevents or minimizes the occurrence of stray water droplets or mist. Consequently, substantially all of the water droplets that are sprayed end up on the web 90 and contribute to the cooling of the web 90, and do not escape from the electrostatic cooler 58.

The electrostatic cooler 58 has a housing or cabinet 120 which substantially encloses the spray nozzles 100 and the upper and lower field directors 110, 112. The cabinet 120 has a pair of rectangular slots 122 formed therein to accommodate passage of the web 90 through the cooler 58, and the cabinet 120 has a lower cabinet portion 124 with a built-in drain 126 to facilitate drainage of any water that leaks from the water header pipe 102 or the nozzles 100.

Figure 7:
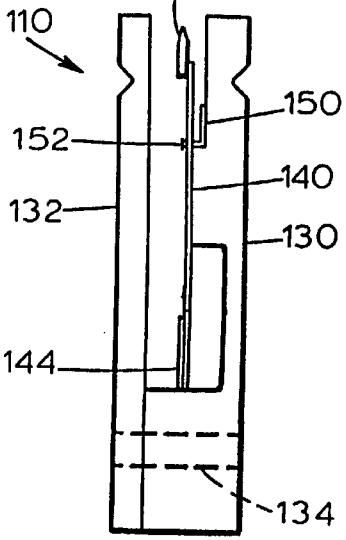
FIG. 7 is an end view of a field director used in the electrostatic cooler.
Figure 6:
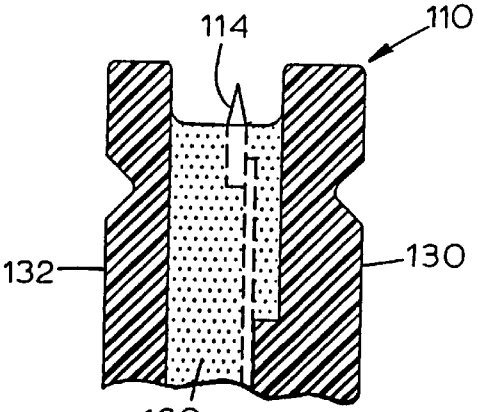
FIG. 6 is a cross-sectional end view of a portion of a field director used in the electrostatic cooler.
Figure 5:
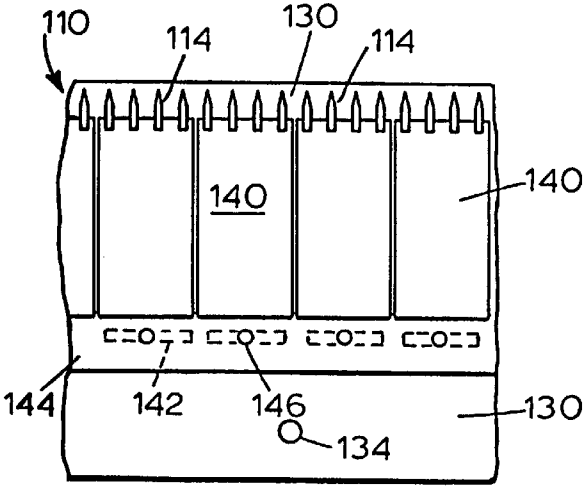
FIG. 5 is a side view of a portion of a field director used in the electrostatic cooler.

The structure of the upper field directors 110 is shown in more detail in FIGS. 5–7. Referring to those figures, the upper field directors 110 have a generally U-shaped dielectric housing formed of a first housing portion 130 and a second housing portion 132 which is mounted to the first housing portion via bolts (not shown) which pass through a number of bores 134 periodically spaced along the length of the housing portions 130, 132.

As shown in FIG. 5, the pointed electrodes 114 are mounted to a plurality of conventional electrode plates 140, which are commercially available from Metallux. Each plate 140, which is composed of a ceramic material, has four of the pointed electrodes 114 mounted to it. The four electrodes 114 on each plate 140 are conductively interconnected by a metallized path (not shown), which is in turn conductively connected to a serpentine resistive path (not shown) plated onto each electrode plate 140. The serpentine resistive path of each plate 140 is conductively connected to a relatively small rectangular metal terminal 142 mounted on each plate 140.

A metal bar 144 is used to conductively interconnect the electrode plates 140. The metal bar 144 has a plurality of circular holes 146 formed therein, the holes 146 being spaced to coincide with and overlap the rectangular terminals 142 of the electrode plates 140. Each of the rectangular terminals 142 may be conductively connected to the metal bar 144 by solder disposed in each of the holes 146.

The spacing of the electrode plates 140 may be fixed by an elongate, metal or plastic spacer strip 150 (FIG. 7) that runs the length of each upper field director 110. The spacer strip 150 may have periodically spaced tabs 152 between which the electrode plates 140 are disposed.

As shown in FIG. 6, a potting material 160 occupies the interior portion of the U-shaped housing of the upper field directors 110. The potting material 160 covers all the internal components of the upper field directors 110 except the very tips of the electrodes 114 (the potting material 160 is not shown in FIGS. 5 and 7 so that the internal structure of the upper field directors 110 is more readily apparent).

The lower field directors 112 are generally similar in construction to the upper field directors 110 described above, except that the lower field directors 112 do not have the electrode plates 140 since no electrical resistance is needed in the lower field directors 112 due to their connection to electrical ground. Also, the spacing of the pointed electrodes 114 of the upper field directors 110 may be different than the spacing of the pointed electrodes 118 of the lower field directors 112. For example, the electrodes 114 could be spaced 5 millimeters apart, while the electrodes 118 could be spaced 25 millimeters apart.

Although it is generally preferable to use upper and lower field directors 110, 112 which have evenly spaced, pointed electrodes 114, 118 to generate a substantially uniform electrostatic field, the particular structure of the upper and lower field directors 110, 112 is not considered important to the invention, and other structures could be used.

The spacing of the field directors 110, 112 (as shown in FIG. 3) could be varied, and the upper and lower field directors 110, 112 could be reversed, so that the field directors 110 are disposed below the web 90 and the field directors 112 are disposed above the web 90.

The use of the electrostatic cooler 58 has a number of advantages. When used after the dryer in a web-offset press, the number of chill rolls needed to reduce the temperature of the web may be reduced, saving substantial cost. Alternatively, it may be possible to eliminate the need for the chill rolls entirely via the use of an electrostatic cooler.

Also, the use of the electrostatic cooler 58 may reduce the cost of the dryer used to set the ink. A dryer used in a web-offset press typically has multiple dryer sections, each of which is typically heated to a different temperature. For example, the dryer may have a first dryer section into which the web passes that is heated to 260° F., a second dryer section which is heated to 280° F., and a third dryer section which is heated to 240° F. The use of the electrostatic cooler 58 adjacent a multi-section dryer may eliminate the need for the final dryer section, thus reducing the cost of the dryer significantly. In that case, the printing press 50 may include a dryer having only two sections, a first section (shown schematically in FIG. 2 as 56*a*) heated to a first temperature of at least about 200° F. and a second section (shown schematically is FIG. 2 as 56*b*) heated to a second temperature of about 200° F., the second temperature being different than the first temperature, and an electrostatic cooler connected directly adjacent the two-section dryer.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of operating a web-offset printing press comprising the steps of:

(a) applying a heat-settable ink to a web with a rotatable printing cylinder;

(b) passing said web through a drying station after said heat-settable ink has been applied to said web during said step (a), said web being at an initial temperature when said web passes out of said drying station;

(c) generating a directed electrostatic field;

(d) causing said web to pass through said directed electrostatic field after said web passes out of said drying station;

(e) spraying liquid droplets through said directed electrostatic field and onto said web after said web passes out of said drying station to cause said initial temperature of said web to be reduced to a second temperature, said second temperature being at least about 20° F. lower than said initial temperature; and (f) after said step (e), causing said web to pass through a cooling station including cooling apparatus to cause said second temperature of said web to be reduced to a third temperature, said third temperature being at least about 20° F. lower than said second temperature.

2. A method as defined in claim 1 wherein said step (e) causes said second temperature of said web to be at least about 50° F. lower than said initial temperature of said web.

3. A method as defined in claim 1 wherein said step (e) causes said second temperature of said web to be at least about 100° F. lower than said initial temperature of said web.

4. A web-offset printing press, comprising:

a first rotatable printing cylinder adapted to print a first image on a web by applying a heat-settable ink to said web;

a second rotatable printing cylinder adapted to print a second image on said web, said second image being printed on said web subsequent to said first image being printed on said web by applying a heat-settable ink to said web;

a drying station for drying said heat-settable ink applied to said web by said first and second rotatable printing cylinders, said drying station applying heat to said web to cure said heat-settable ink applied to said web by said first and second rotatable printing cylinders, said web being at an initial temperature when said web passes out of said drying station;

a first cooling station disposed adjacent said drying station, said first cooling station receiving said web after said web has been heated by said drying station, said first cooling station causing said initial temperature of said web to be reduced by at least about 20° F. to a second temperature, said first cooling station comprising:

a generator adapted to generate a directed electrostatic field through which said web passes; and a sprayer adapted to spray water droplets onto said web to cool said web by evaporation of said water droplets from said web, said electrostatic field causing said water droplets to pass through a confined path between said sprayer and said web; and a second cooling station disposed adjacent said first cooling station for cooling said web, said second cooling station including cooling apparatus receiving said web after said web passes out of said first cooling station, said second cooling station causing said second temperature of said web to be reduced by at least about 20° F.

5. A printing press as defined in claim 4 wherein said generator comprises:

a first field director disposed on a first side of said web, said first field director having a plurality of pointed electrodes;

a second field director disposed on a second side of said web opposite said first side, said second field director having a plurality of pointed electrodes; and a power supply for supplying a relatively high voltage to said pointed electrodes of one of said first or second field directors.

6. A printing press as defined in claim 4 wherein said sprayer comprises a plurality of atomizing spray nozzles each of which is connected to a source of liquid and to a source of air.

7. A printing press as defined in claim 4 wherein said first cooling station additionally comprises a cabinet for substantially enclosing said generator and said sprayer.

8. A web-offset printing press, comprising:

a first rotatable printing cylinder adapted to print a first image on a web by applying a heat-settable ink to said web;

a second rotatable printing cylinder adapted to print a second image on said web, said second image being printed on said web subsequent to said first image being printed on said web by applying a heat-settable ink to said web;

a drying station for drying said heat-settable ink applied to said web by said first and second rotatable printing cylinders, said drying station applying heat to said web to cure said heat-settable ink applied to said web by said first and second rotatable printing cylinders, said web being at an initial temperature when said web passes out of said drying station;

a first cooling station disposed adjacent said drying station, said first cooling station receiving said web after said web has been heated by said drying station, said first cooling station causing said initial temperature of said web to be reduced by at least about 20° F. to a second temperature, said first cooling station comprising:

a generator adapted to generate a directed electrostatic field through which said web passes; and a sprayer adapted to spray water droplets onto said web to cool said web by evaporation of said water droplets from said web, said electrostatic field causing said water droplets to pass through a confined path between said sprayer and said web; and a second cooling station disposed adjacent said first cooling station for cooling said web, said second cooling station receiving said web after said web passes out of said first cooling station, said second cooling station causing said second temperature of said web to be reduced by at least about 20° F., said second cooling station comprising a plurality of chill rolls.

9. A printing press as defined in claim 8 wherein said sprayer comprises a plurality of spray nozzles disposed in a direction transverse to a longitudinal axis of said web.

10. A printing press as defined in claim 8 wherein said sprayer comprises a plurality of atomizing spray nozzles each of which is connected to a source of liquid and to a source of air.

11. A printing press as defined in claim 8 wherein said first cooling station additionally comprises a cabinet for substantially enclosing said generator and said sprayer.

12. A printing press as defined in claim 8 wherein said generator comprises:

a first field director disposed on a first side of said web, said first field director having a plurality of pointed electrodes;

a second field director disposed on a second side of said web opposite said first side, said second field director having a plurality of pointed electrodes; and a power supply for supplying a relatively high voltage to said pointed electrodes of one of said first or second field directors.

13. A web-offset printing press, comprising:

a first rotatable printing cylinder adapted to print a first image on a web by applying a heat-settable ink to said web;

a second rotatable printing cylinder adapted to print a second image on said web, said second image being printed on said web subsequent to said first image being printed on said web by applying a heat-settable ink to said web;

a drying station for drying said heat-settable ink applied to said web by said first and second rotatable printing cylinders, said drying station applying heat to said web to cure said heat-settable ink applied to said web by said first and second rotatable printing cylinders, said web being at an initial temperature when said web passes out of said drying station;

a cooling station disposed adjacent said drying station, said cooling station receiving said web after said web has been heated by said drying station, said cooling station causing said initial temperature of said web to be reduced by at least about 20° F., said cooling station comprising:

a generator adapted to generate a directed electrostatic field through which said web passes; and a sprayer adapted to spray liquid droplets onto said web to cool said web by evaporation of said liquid droplets from said web, said electrostatic field causing said liquid droplets to pass through a confined path between said sprayer and said web; and at least one chill roll for further cooling said web after said web passes through said cooling station.

14. A printing press as defined in claim 13 wherein said generator and said sprayer cause said initial temperature of said web to be reduced by at least about 50° F.

15. A printing press as defined in claim 13 wherein said generator and said sprayer cause said initial temperature of said web to be reduced by at least about 100° F.

16. A web-offset printing press, comprising:

a first rotatable printing cylinder adapted to print a first image on a web by applying a heat-settable ink to said web;

a second rotatable printing cylinder adapted to print a second image on said web, said second image being printed on said web subsequent to said first image being printed on said web by applying a heat-settable ink to said web;

a two-section dryer for drying said heat-settable ink applied to said web by said first and second rotatable printing cylinders, said dryer applying heat to said web to cure said heat-settable ink applied to said web by said first and second rotatable printing cylinders, said web being at an initial temperature when said web passes out of said dryer, said dryer having only two drying sections, a first drying section heated to a first temperature of at least about 200° F. and a second drying section heated to a second temperature of at least about 200° F., said second temperature being different than said first temperature;

a cooling station disposed adjacent said two-section dryer, said cooling station receiving said web after said web has been heated by said dryer, said cooling station causing said initial temperature of said web to be reduced by at least about 20° F., said cooling station comprising:

a generator adapted to generate a directed electrostatic field through which said web passes; and a sprayer adapted to spray liquid droplets onto said web to cool said web by evaporation of said liquid droplets from said web, said electrostatic field causing said liquid droplets to pass through a confined path between said sprayer and said web; and at least one chill roll for further cooling said web after said web passes through said cooling station.

17. A method of operating a web-offset printing press comprising the steps of:

(a) applying a heat-settable ink to a web with a rotatable printing cylinder;

(b) passing said web through a drying station after said heat-settable ink has been applied to said web during said step (a), said web being at an initial temperature when said web passes out of said drying station;

(c) generating a directed electrostatic field;

(d) causing said web to pass through said directed electrostatic field after said web passes out of said drying station;

(e) spraying liquid droplets through said directed electrostatic field and onto said web after said web passes out of said drying station to cause said initial temperature of said web to be reduced to a second temperature, said second temperature being at least about 20° F. lower than said initial temperature; and (f) after said step (e), causing said web to be cooled by at least one chill roll to cause said second temperature of said web to be reduced to a third temperature, said third temperature being at least about 20° F. lower than said second temperature.

* * * * *